US008186848B2

(12) United States Patent
Lim et al.

(10) Patent No.: US 8,186,848 B2
(45) Date of Patent: May 29, 2012

(54) LIGHTING DEVICE

(75) Inventors: Dong Nyung Lim, Gwangju (KR); Eun Hwan Kim, Uiwang-si (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/099,761

(22) Filed: May 3, 2011

(65) Prior Publication Data

US 2011/0205743 A1 Aug. 25, 2011

Related U.S. Application Data

(63) Continuation of application No. 12/656,501, filed on Feb. 1, 2010.

(30) Foreign Application Priority Data

Jun. 5, 2009 (KR) ..... 10-2009-0049987

(51) Int. Cl.
*F21S 4/00* (2006.01)

(52) U.S. Cl. ..... 362/231; 362/249.02; 362/294; 362/249.11; 362/235

(58) Field of Classification Search ..... 362/249.02, 362/294, 373, 249.1, 249.11, 235
See application file for complete search history.

(56) References Cited

U.S. PATENT DOCUMENTS

| | | | | |
|---|---|---|---|---|
| 5,632,551 | A * | 5/1997 | Roney et al. | 362/485 |
| 7,726,837 | B2 * | 6/2010 | Ewert | 362/249.02 |
| 7,780,313 | B2 * | 8/2010 | Lam et al. | 362/249.02 |
| 7,950,826 | B2 * | 5/2011 | Shin | 362/249.02 |
| 2006/0002125 | A1 | 1/2006 | Kim et al. | |
| 2006/0215408 | A1 | 9/2006 | Lee | |
| 2006/0279949 | A1 | 12/2006 | Shin et al. | |
| 2010/0002435 | A1 * | 1/2010 | Rash | 362/235 |
| 2011/0141734 | A1 * | 6/2011 | Li et al. | 362/235 |

FOREIGN PATENT DOCUMENTS

| | | |
|---|---|---|
| KR | 20-0377622 | 3/2005 |
| KR | 10-0496522 | 6/2005 |
| KR | 10-2005-0099136 | 10/2005 |
| KR | 10-2006-0002092 | 1/2006 |
| KR | 10-2006-0128443 | 12/2006 |
| KR | 20-2009-0008634 | 8/2009 |

OTHER PUBLICATIONS

Korean Notice of Allowance issued in KR Application No. 10-2009-0049987 dated Dec. 29, 2010 (full Korean text and full English translation).

Korean Office Action issued in KR Application No. 10-2009-0049987 dated Aug. 31, 2010 (full Korean text and full English translation).

* cited by examiner

*Primary Examiner* — Anabel Ton
(74) *Attorney, Agent, or Firm* — KED & Associates, LLP

(57) ABSTRACT

A lighting device includes a case body including a receiving cavity and at least a portion including at least one first hole, a light emitting module in the receiving cavity, the light emitting module including a plurality of light emitting devices, a lens on the light emitting module, and a case cover including an opening through which the lens is exposed, the case cover being disposed on the case body. A heat sink is between the light emitting module and the case body to transfer heat from the light emitting module to the case where the case body acts as a conduit to transfer heat from the light emitting module to the portion of the case body including at least one first hole and the case cover has at least a portion including at least one second hole and the first hole of the case body corresponds with the second hole of the case cover.

20 Claims, 6 Drawing Sheets

LIGHTING DEVICE

The present application is a 37 C.F.R. §1.53(b) continuation of U.S. patent application Ser. No. 12/656,501 filed on Feb. 1, 2010, currently pending, which claims priority under 35 U.S.C. 119 and 35 U.S.C. 365 to Korean Patent Application No. 10-2009-0049987 filed on Jun. 5, 2009, which is hereby incorporated by reference in its entirety.

BACKGROUND

Embodiments relate to a lighting device.

Light emitting diodes (LEDs) are semiconductor devices configured to convert electrical energy to light. Such LEDs have low power consumption, semi-permanent service life, rapid response speed, stability, and environmentally-friendly properties, relative to related art light sources such as fluorescent lamps and incandescent lamps. Thus, much research has been carried out to replace related art light sources with LEDs, which are increasingly being employed as the light sources of lighting devices used indoors and outdoors, including various lamps, liquid crystal display devices, electronic display boards, and street lamps.

SUMMARY

In one embodiment, a lighting device comprises: a case body comprising a receiving cavity and at least a portion including at least one first hole; a light emitting module in the receiving cavity, the light emitting module including a plurality of light emitting devices; a lens on the light emitting module; and a case cover including an opening through which the lens is exposed, the case cover being disposed on the case body; and a heat sink between the light emitting module and the case body to transfer heat from the light emitting module to the case body, wherein the case body acts as a conduit to transfer heat from the lighting emitting module to the portion of the case body including at least one first hole and the case cover has at least a portion including at least one second hole and the first hole of the case body corresponds with the second hole of the case cover.

In another embodiment, a lighting device comprises: a case body including a cavity; a light emitting module disposed in the cavity of the case body, the light emitting module including a plurality of light emitting devices; a lens on the light emitting module; and a case cover including an opening through which the lens is exposed, the case cover being disposed on a circumference of the lens and the case body, wherein the case body has an inner wall and an outer wall forming at least one first heat dissipating portion and the case cover has an inner wall and an outer wall forming at least one second heat dissipating portion, wherein the first heat dissipating portion corresponds with the second heat dissipating portion.

In further another embodiment, a lighting device comprises: a case body including a cavity and a through-hole in a bottom surface of the cavity; a light emitting module in the cavity, the light emitting module including a plurality of light emitting devices; a lead electrode electrically connected to the light emitting module, the lead electrode being exposed to the outside through the through-hole; a gap member on the light emitting module, the gap member including an electrode penetration portion through which the lead electrode passes; a lens on the gap member; and a case cover including an opening through which the lens is exposed, the case cover being disposed on the lens and the case body.

The details of one or more embodiments are set forth in the accompanying drawings and the description below. Other features will be apparent from the description and drawings, and from the claims.

DETAILED DESCRIPTION OF THE EMBODIMENTS

Figure 1:
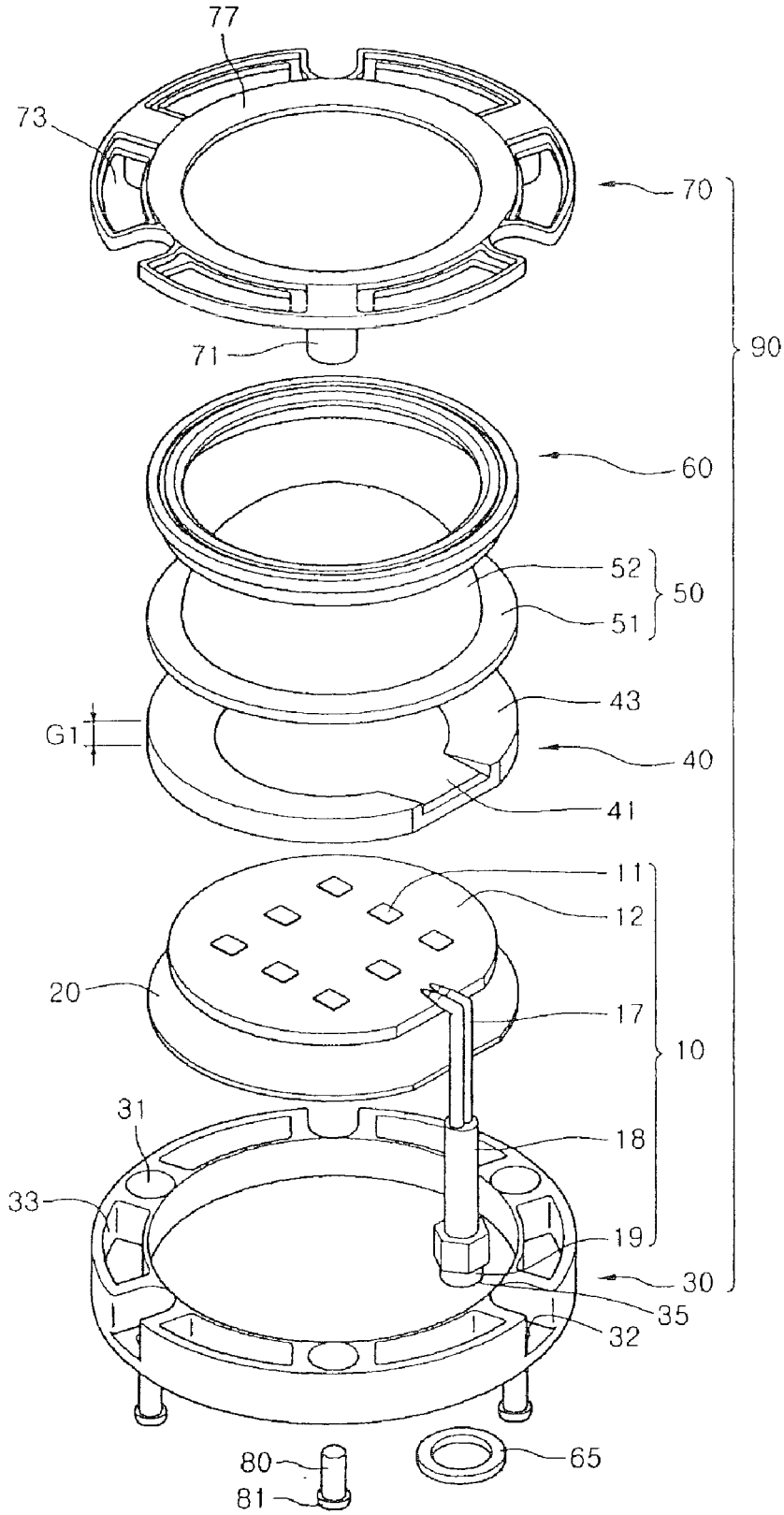
FIG. 1 is an exploded perspective view of a lighting device according to a first embodiment.

In the descriptions of embodiments, it will be understood that when a layer (or film), a region, a pattern, or a structure is referred to as being 'on/above/over/upper' substrate, each layer (or film), a region, a pad, or patterns, it can be directly on substrate each layer (or film), the region, the pad, or the patterns, or intervening layers may also be present. In addition, spatially relative terms, such as "upper" and "lower" are used herein for ease of description to describe one element or feature's relationship to another element(s) or feature(s) as illustrated in the drawings.

In the drawings, thicknesses and sizes of layers are exaggerated, omitted, or schematically illustrated for clarity. In addition, the sizes of elements illustrated in the drawings may not correspond to their actual sizes.

Hereinafter, a lighting device according to a first embodiment will be described with reference to the accompanying drawings.

Figure 2:
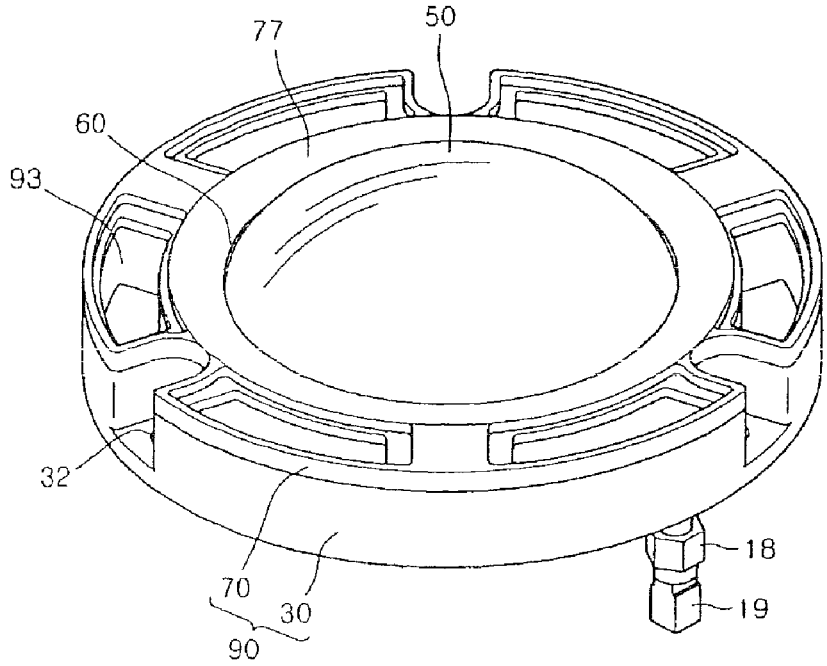
FIG. 2 is a perspective view of the lighting device according to the first embodiment when viewed from above.
Figure 3:
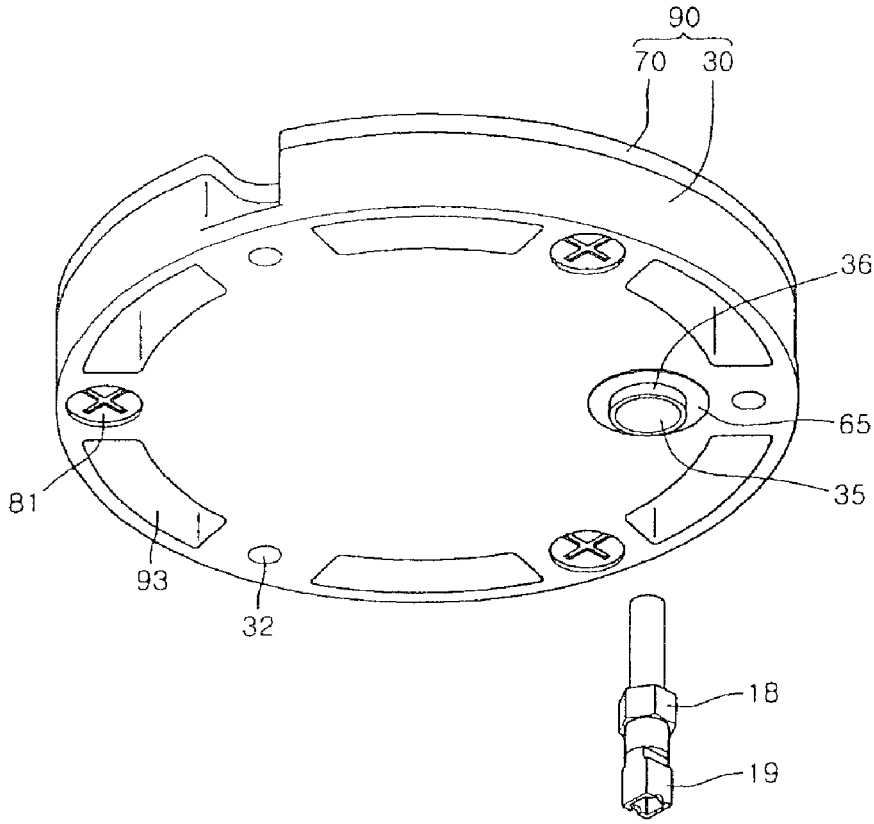
FIG. 3 is a perspective view of the lighting device according to the first embodiment when viewed from below.
Figure 4:
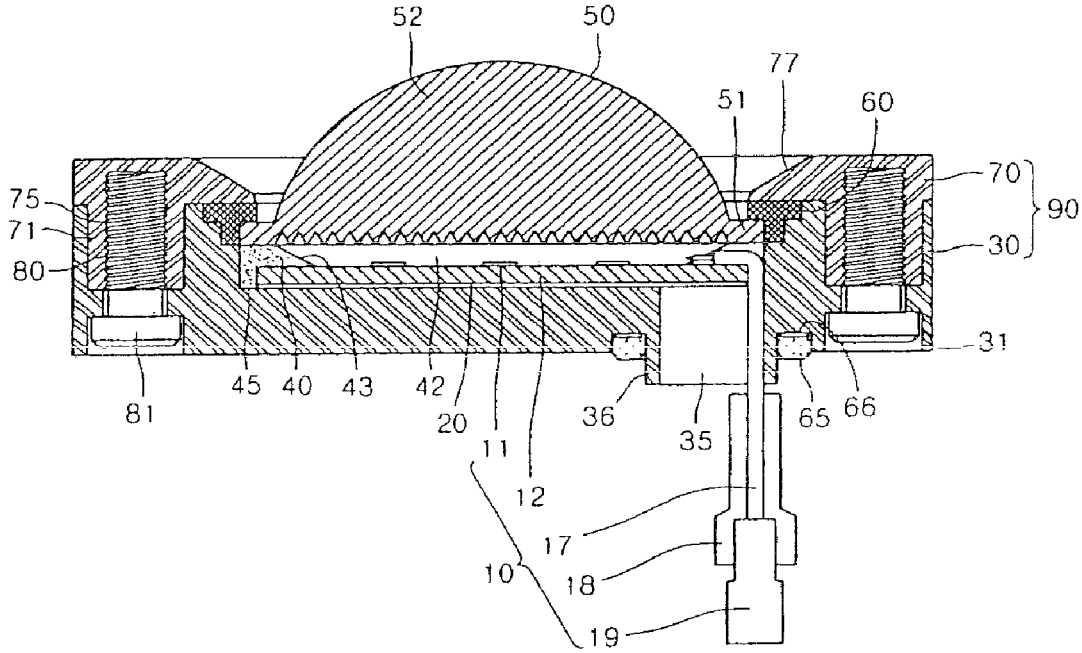
FIG. 4 is a sectional view of the lighting device according to the first embodiment.

FIG. 1 is an exploded perspective view of a lighting device according to a first embodiment, and FIG. 2 is a perspective view of the lighting device according to the first embodiment when viewed from above. FIG. 3 is a perspective view of the lighting device according to the first embodiment when viewed from below, and FIG. 4 is a sectional view of the lighting device according to the first embodiment.

Referring to FIGS. 1 to 4, a lighting device according to a first embodiment includes a case body 30, a heatsink plate 20 in a receiving cavity of the case body 30, a light emitting module 10 on the heatsink plate 20, a gap member 40 on the light emitting module 10, a lens 50 on the gap member 40, a first protection ring 60 on an edge 51 of the lens 50, and a case cover 70 on the first protection ring 60 and the case body 30.

The case body 30 and the case cover 70 are coupled and fixed to each other by a coupling screw 80 to form a case 90 of the lighting device.

The heatsink plate 20 radiates heat generated from the light emitting module 10.

The light emitting module 10 may include a substrate 12, a plurality of light emitting devices 11 mounted on the substrate 12, and a lead electrode 17 transmitting power to the plurality of light emitting devices 11.

A portion of the lead electrode 17 may be exposed to the outside through a through-hole 35 passing through a bottom surface of the case body 30 and electrically connected to an external power source.

A protection tube 18 may surround the exposed lead electrode 17 to protect the exposed portion of the lead electrode 17 from exterior environment such as heat or moisture. A connection terminal 19 may be disposed on an end of the lead electrode 17 to connect the lead electrode 17 to the external power source through the connection terminal 19.

The lens 50 adjusts light generated from the light emitting module 10 to realize desired light distribution.

The gap member 40 may space the light emitting module from the lens 50 by a predetermined gap G1 to form a space between the light emitting muddle 10 and the lens 50, thereby inducing a desired light emitting angle and the desired light distribution.

The first protection ring 60 is disposed between the case cover 70 and the lens 50 to prevent moisture from being permeated into the lighting device.

A second protection ring 65 may be disposed on an outer circumference of a circumference surface of the through-hole 35 of the bottom surface of the case body 30 when the lighting device is attached to an external support member.

Hereinafter, components of the lighting device according to the first embodiment will be described in detail.

Referring to FIGS. 1 to 4, the case body 30 may have a circular-shaped body with a receiving space such as a receiving cavity. Also, the case cover 70 may have a circular ring shape corresponding to that of the case body 30.

The case body 30 and the case cover 70 are coupled to each other to form the case 90. The case 90 constitutes a body of the lighting device to receive the heatsink plate 20, the light emitting module 10, the gap member 40, the lens 50, and the first protection ring 60.

The heatsink plate 20 is disposed in the receiving space such as the receiving cavity of the case body 30, and the light emitting module 10 is disposed on the heatsink plate 20. The gap member 40 is disposed on a circumference of the light emitting module 10, and the lens 50 is disposed on the gap member 40. The first protection ring 60 is disposed on the edge 51 of the lens 50, and the case cover 70 is disposed on the first protection ring 60 and the case body 30. Here, the lens 50 is exposed through an opening of the case cover 70.

A shape of the case 90, e.g., the shapes of the circumference surfaces of the case body 30 and the case cover 70 are not limited to the circular shape and may be variously varied.

The case 90 may be formed of a material having a superior thermal dissipation property. For example, the case 90 may be formed of a metal material, e.g., at least one of aluminum (Al), nickel (Ni), copper (Cu), silver (Ag), and tin (Sn). Also, plating may be disposed on a surface of the case 90.

Alternatively, the case 90 may be formed of a resin material, but is not limited thereto.

The circumference surface of the case body 30 may have an inner wall and an outer wall. A first hole 31, a second hole 32, and a first heatsink hole 33 may be disposed between the inner wall and the outer wall.

Also, the circumference surface of the case cover 70 may have an inner wall and an outer wall. A protrusion 71 and a second heatsink hole 73 may be disposed between the inner wall and the outer wall.

Here, the outer walls may not be disposed at a portion of the circumference surfaces of the case body 30 and the case cover 70 in which the second hole 32 is disposed.

Referring to FIG. 4, the protrusion 71 may include a screw groove 75. The protrusion 71 is inserted into the first hole 31, and the coupling screw 80 is inserted into the screw groove 75 and the first hole 31. As a result, the case body 30 and the case cover 70 may be firmly fixed and coupled to each other.

The coupling screw 80 may be inserted from the first hole 31 of the case body 30 into the screw groove 75 of the protrusion 71 of the case cover 70 so that the head 81 of the coupling screw 80 faces down. Thus, when the coupling screw 80 is inserted from the first hole 31, the coupling screw 80 may not be exposed to a top surface of the case cover 70. However, a coupling method of the coupling screw 80 may be various changed.

The case 90, e.g., the case body 30 and the case cover may be coupled or separated to/from each other using the coupling screw 80. Thus, when the lighting device has broken down, the coupling screw 80 is inserted or removed to easily perform maintenance and repair of the lighting device.

Referring to FIGS. 1 to 3, a screw may be inserted into the second hole 32 of the case body 30 to couple the lighting device to the external support member such as a wall surface, a streetlight, or an automobile as necessary. Here, as described above, the outer walls may not be disposed at the portion of the circumference surfaces of the case body 30 and the case cover 70 in which the second hole 32 is disposed, so that the screw is smoothly inserted into the second hole 32.

The first heatsink hole 33 of the case body 30 and the second heatsink hole 73 of the case cover 70 constitute a heatsink hole 93 of the case 90. The heatsink hole 93 may enlarge a surface area of the case 90 to effectively radiate the heat generated from the light emitting module 10. Also, when compared to a case in which the heatsink hole 93 is not formed, the lighting device may be reduced in weight.

Referring to FIGS. 3 and 4, the through-hole 35 may be disposed in the bottom surface of the case body 30. The portion of the lead electrode 17 of the light emitting module is exposed to the outside through the through-hole 35 and connected to the external power source.

A circumference surface 36 of the through-hole 35 may protrude from the bottom surface of the case body 30. Since the circumference surface 36 of the through-hole 35 protrudes, the lighting device may be exactly installed to the external support member.

Also, the second protection ring 65 may be disposed on the outer circumference of the circumference surface of the through-hole 35. When the lighting device is attached to the external support member, the second protection ring 65 may prevent the moisture from being permeated into the lighting device through the through-hole 35 to improve reliability of the lighting device.

A ring groove 66 having a shape corresponding to that of the second protection ring 65 may be disposed in the outer circumference of the circumference surface of the through-hole 35 so that the second protection ring 65 is smoothly installed.

Referring to FIGS. 1, 2, and 4, an inner surface 77 of the case cover 70 may be inclined to effectively radiate the light emitted from the lens 50. Also, the inner surface 77 of the case cover 70 may fix the heatsink plate 20, the light emitting module 10, the gap member 40, the lens 50, and the first protection ring 60, which are received inside the case 90.

Figure 5:
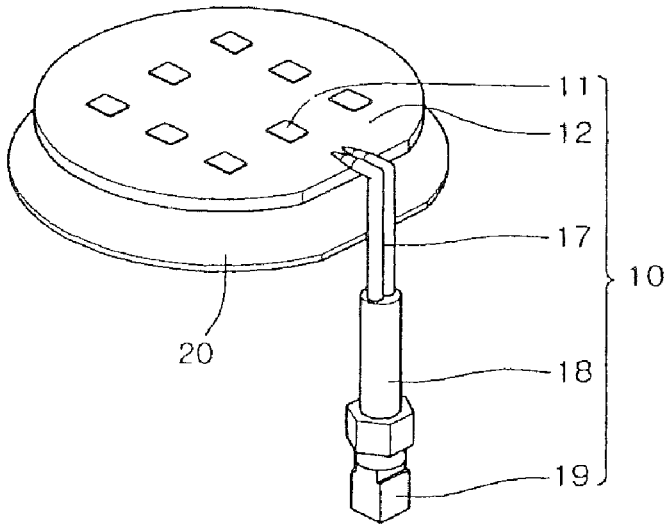
FIG. 5 is a view illustrating a light emitting module of the lighting device.

FIG. 5 is a view illustrating the light emitting module 10 of the lighting device.

Referring to FIGS. 1 and 5, the light emitting module 10 may include the substrate 12, the plurality of light emitting devices 11 mounted on the substrate 12, and a lead electrode 17 transmitting a power to the plurality of light emitting devices 11. The light emitting module 10 provides light to the lighting device.

The light emitting module 10 has a shape corresponding to that of the receiving cavity of the case 90 such that it is received into the case 90. As shown in FIGS. 1 and 5, the light emitting module 10 may have a circular plate shape, but is not limited thereto.

A circuitry is printed on a dielectric to form the substrate 12. The substrate 12 may include an aluminium substrate, a ceramic substrate, a metal core printed circuit board, and a general printed circuit board.

The substrate 12 may have a colored surface, for example, a white colored surface to efficiently reflect light.

The plurality of light emitting devices 11 may be mounted on the substrate 12 in an array form. The mounted configuration and the number of the plurality of light emitting device 11 may be variously changed as necessary.

The plurality of light emitting device 11 may include at least one light emitting diode (LED). The LED may include at least one of a red LED, a green LED, a blue LED, and a white LED, which respectively emit red light, green light, blue light, and white light.

The lead electrode 17 may have one end connected to the substrate 12 and the other end exposed to the outside through the through-hole 35 passing through the bottom surface of the case body 30 and electrically connected to the external power source.

The protection tube 18 may surround the lead electrode 17 exposed to the outside to protect the exposed other end of the lead electrode 17 from the exterior environment such heat or moisture. The connection terminal 19 may be disposed on the exposed terminal end of the other end of the lead electrode 17 to connect the lead electrode 17 to the external power source through the connection terminal 19.

A DC converter for converting an alternating current (AC) into direct current (DC) to supply the converted DC or a protection device for protecting the lighting device from an electrostatic discharge (ESD) effect or a surge effect may be further disposed on the substrate 12.

The heatsink plate 20 may be attached to a floor surface of the light emitting module 10. The heatsink plate 20 may radiate the heat generated from the light emitting module 10 to transmit the heat to the case 90.

The heatsink plate 20 may be formed of a material having thermal conductivity. For example, the heatsink plate 20 may include one of a thermally conductive silicon pad and a thermally conductive tape.

Figure 6:
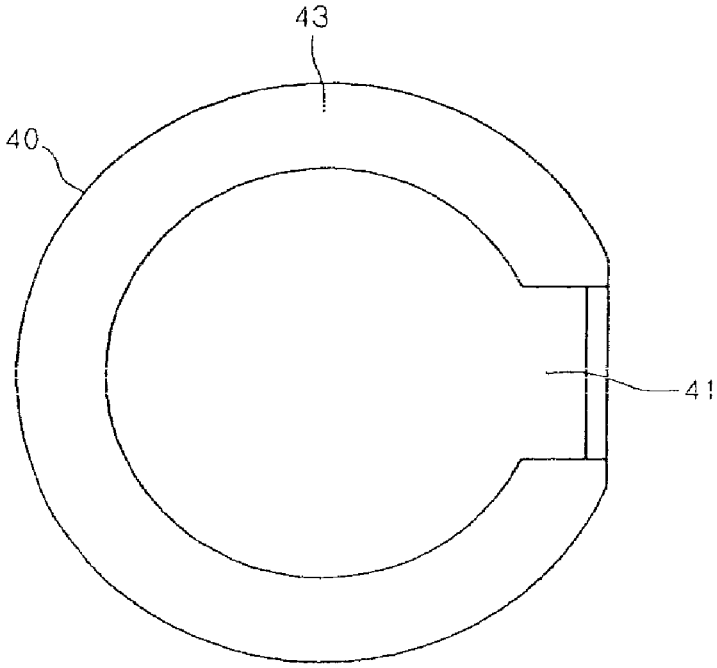
FIG. 6 is a view illustrating a gap member of the lighting device when viewed from above.
Figure 7:
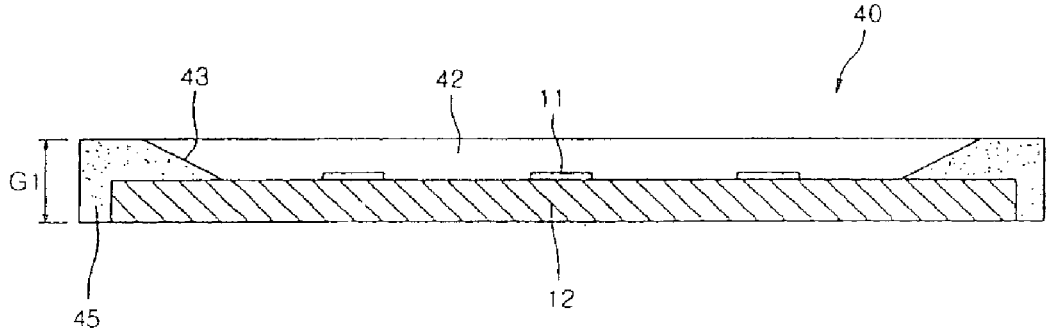
FIG. 7 is a sectional view illustrating the gap member and the light emitting module of the lighting device.

FIG. 6 is a view illustrating a gap member of the lighting device when viewed from above, and FIG. 7 is a sectional view illustrating the gap member and the light emitting module of the lighting device.

Referring to FIGS. 1, 4, 6, and 7, the gap member 40 may be disposed on a circumference between the light emitting module 10 and the lens 50. The gap member 40 may have a circular ring shape with an opening to expose the light emitting devices of the light emitting module 10. Also, an electrode penetration portion 41 through which the lead electrode 17 of the light emitting module 10 passes may be disposed in the gap member 40.

The gap member 40 may be formed of an insulation material, e.g., the resin material, but is not limited thereto. When the gap member 40 is formed of the insulation material, insulation resistivity of the lighting device may be improved.

The gap member 40 may be formed of a material having high reflectivity or have a color having high reflectivity. The color may be a white color. The gap member 40 may increase an amount of light incident from the light emitting module 10 to the lens 50.

Referring to FIGS. 1 and 4, the gap member 40 spaces the light emitting module 10 from the lens 50 by a predetermined gap G1. Light is emitted from the light emitting device 11 of the light emitting module 10 at an angle of about 120°. Thus, to obtain the desired light distribution using the light, the predetermined gap G1 between the light emitting module 10 and the lens 50 may be required.

A space 42 between the lens 50 and the light emitting module 10 is defined by the gap G1 to easily induce the desired light distribution.

A resin material may be filled into the space 42, but is not limited thereto. A phosphor may be contained in the resin material.

An inner surface 43 of the gap member 40 may be inclined at a predetermined angle. The inner surface 43 of the gap member 40 may be inclined such that a thickness of the inner surface 43 of the gap member 40 is tapered from the outside toward the inside. Thus, the light generated from the light emitting module 10 may be effectively led to the lens 50 along the inner surface 43 of the gap member 40.

Referring to FIGS. 4 and 7, the gap member 40 may have a diameter greater than that of the light emitting module 10. A module fixing part 45 may be disposed on the circumference of the bottom surface of the gap member 40 to fix the gap member 40 to the light emitting module 10. Alternatively, the module fixing part 45 may not be provided.

The gap member may not be included in the lighting device if not necessary.

Figure 8:
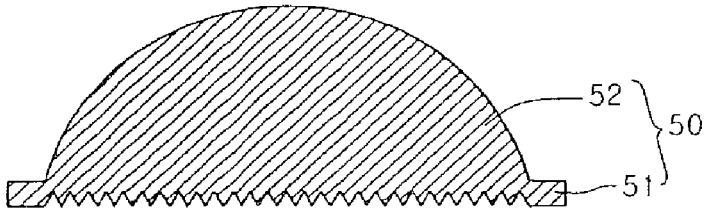
FIG. 8 is a view illustrating an example of a lens of the lighting device.

FIG. 8 is a view illustrating an example of a lens of the lighting device.

Referring to FIGS. 1, 2, 4, and 8, the lens 50 may be disposed on the gap member 40. The lens 50 may include a light emitting part 52 and an edge 51.

The light emitting part 52 adjusts the light distribution of the light generated from the light emitting module 10 to emit the adjusted light. The light emitting part 52 may be exposed through the opening of the case cover 70 to distribute the light.

The edge 51 may be disposed on a circumference of a bottom surface of the light emitting part 52 and have a circular ring shape. The first protection ring 60 may be disposed on the edge 51.

The lens 50 may be injection-molded using a light transmitting material. The light transmitting material may be realized using a plastic material such as glass, poly methyl methacrylate (PMMA), or polycarbonate (PC).

Although the lens 50 has a hemispherical shape, the present disclosure is not limited thereto. As necessary, the lens 50 may have various shapes such as convex and concave shapes.

Also, as shown in FIG. 8, a floor surface of the lens 50, for instance, an incident surface of the lens 50 may have an uneven shape or a prism shape to improve light extraction efficiency and obtain the desired light distribution. FIG. 8 illustrates an example of the floor surface shape of the lens 50, but is not limited thereto.

The case body 30 and the case cover 70 may be separated from each other to replace the lens 50 with a lens having the desired light distribution. Thus, the lighting device may be used for various purposes.

The first protection ring 60 is disposed on the edge 51 of the lens 50.

Referring to FIG. 4, the first protection ring 60 may have a circular ring shape to surround top and circumference surfaces of the edge 51. As shown in FIG. 4, the first protection ring 60 may be disposed between the edge 51 of the lens 50 and the inner surface 77 of the case cover 70.

The first protection ring 60 may be formed of a material through which moisture does not pass. For example, the first protection ring 60 may be formed of rubber for waterproof or a silicon material.

Since first protection ring 60 surrounds the top and circumference surfaces of the edge 51 to fill a space between the lens 50 and the case cover 70, the moisture is not penetrated through the space to improve reliability of the lighting device.

Referring to FIGS. 3 and 4, the second protection ring may be disposed on the outer circumference of the circumference surface 36 of the through-hole 35 disposed in the bottom surface of the case body 30. When the lighting device is attached to the external support member, the second protection ring 65 may prevent the moisture from being permeated into the lighting device through the through-hole 35 to improve reliability of the lighting device.

Here, the ring groove 66 may be disposed in the outer circumference of the circumference surface 36 of the through-hole 35 so that the second protection ring 65 is smoothly installed.

The second protection ring 65 may be formed of a material through which the moisture does not pass. For example, the second protection ring 65 may be formed of rubber for waterproof or a silicon material.

Hereinafter, components of a lighting device according to a second embodiment will be described in detail. In descriptions of the second embodiment, the same components as those of the first embodiment will be described with reference to the first embodiment, and the duplicated descriptions will be omitted.

Figure 9:
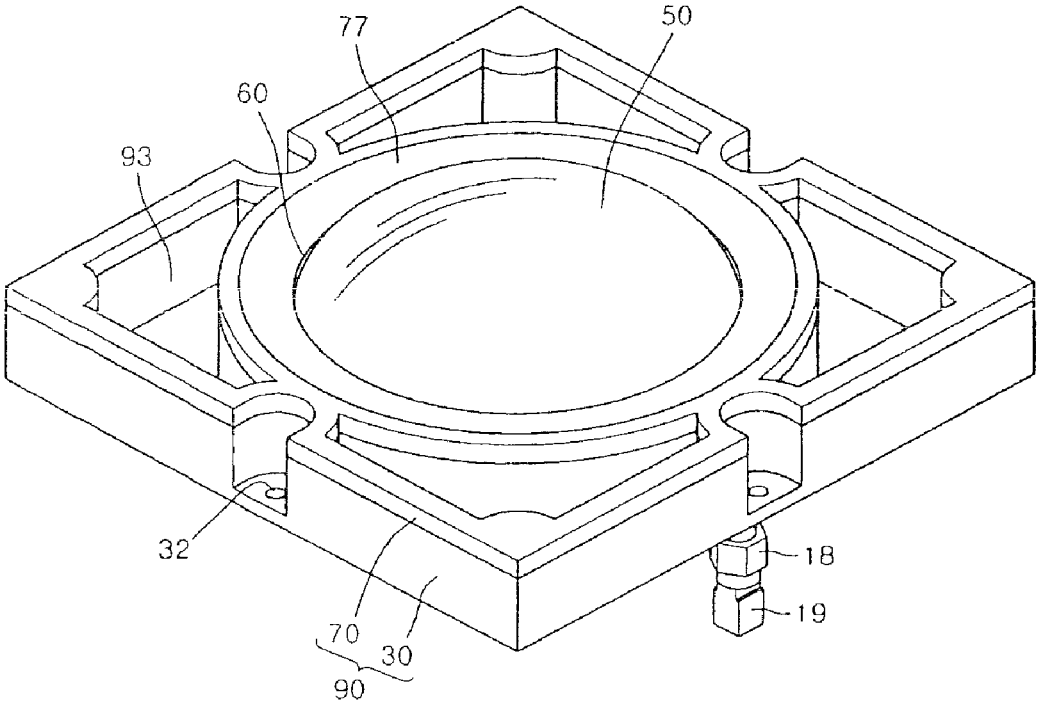
FIG. 9 is a perspective view of a lighting device according to a second embodiment when viewed from above.

FIG. 9 is a perspective view of a lighting device according to a second embodiment when viewed from above.

Referring to FIG. 9, a case body 30 has a square-shaped body with a receiving space such as a receiving cavity. Also, a case cover 70 has a square ring shape corresponding to that of the case body 30.

The case body 30 and the case cover 70 are coupled to each other to form the case 90 having a square shape. The case constitutes a body of the lighting device to receive a heatsink plate 20, a light emitting module 10, a gap member 40, a lens 50, and a first protection ring 60.

That is, the case 90 may have various shapes within the technical range of the present disclosure. For example, the case 90 may have a circular shape, a square shape, a polygonal shape, or an oval shape.

Hereinafter, components of a lighting device according to a third embodiment will be described in detail. In descriptions of the third embodiment, the same components as those of the first embodiment will be described with reference to the first embodiment, and the duplicated descriptions will be omitted.

Figure 10:
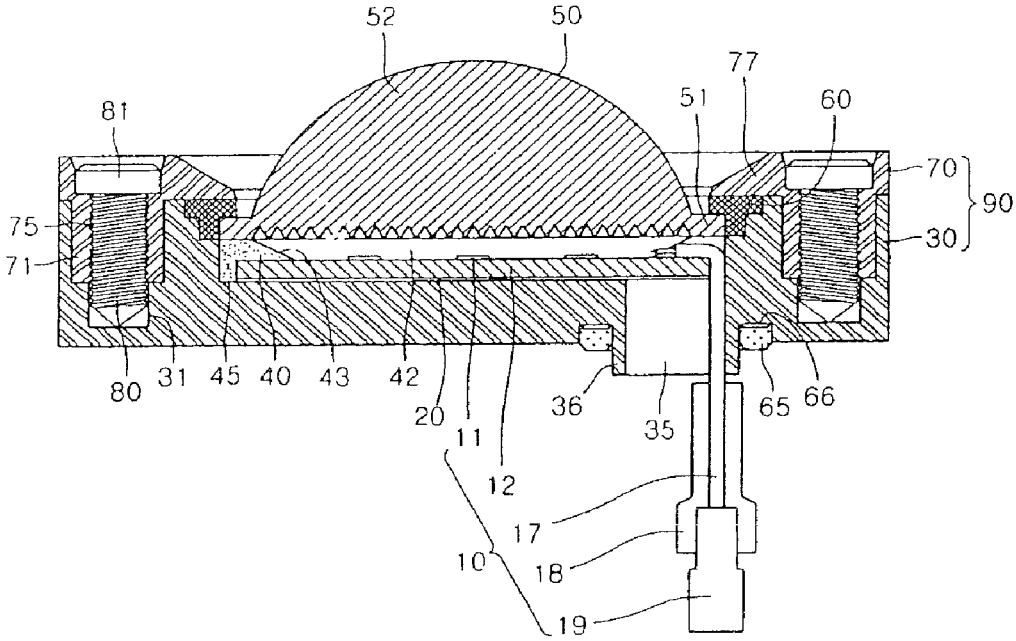
FIG. 10 is a sectional view of a lighting device according to a third embodiment.

FIG. 10 is a sectional view of a lighting device according to a third embodiment.

Referring to FIG. 10, a circumference surface of a case body 30 may have an inner wall and an outer wall. A first groove 31, a second hole (not shown), and a first heatsink hole (not shown) may be disposed between the inner wall and the outer wall.

Also, a circumference surface of a case cover 70 may have an inner wall and an outer wall. A protrusion 71 and a second heatsink hole (not shown) may be disposed between the inner wall and the outer wall.

Referring again to FIG. 10, a protrusion 71 may include a screw hole 75. The protrusion 71 is inserted into the first groove 31, and a coupling screw 80 is inserted into the screw hole 75 and the first groove 31. As a result, the case body 30 and the case cover 70 may be firmly fixed and coupled to each other.

The coupling screw 80 may be inserted from the screw hole 75 of the protrusion 71 of the case cover 70 into the first groove 31 of the case body 30 so that a head 81 of the coupling screw 80 faces upward. Thus, when the coupling screw 80 inserted from the screw hole 75, the coupling screw 80 may be exposed to a top surface of the case cover 70. As a result, the coupling screw 80 may be easily inserted or removed.

Thus, when the lighting device has broken down, the coupling screw 80 is inserted or removed to easily perform maintenance and repair of the lighting device.

A method of coupling and fixing the case cover 70 to the case body 30 is not limited to the first and third embodiments and may be various changed.

Hereinafter, components of a lighting device according to a fourth embodiment will be described in detail. In descriptions of the fourth embodiment, the same components as those of the first embodiment will be described with reference to the first embodiment, and the duplicated descriptions will be omitted.

Figure 11:
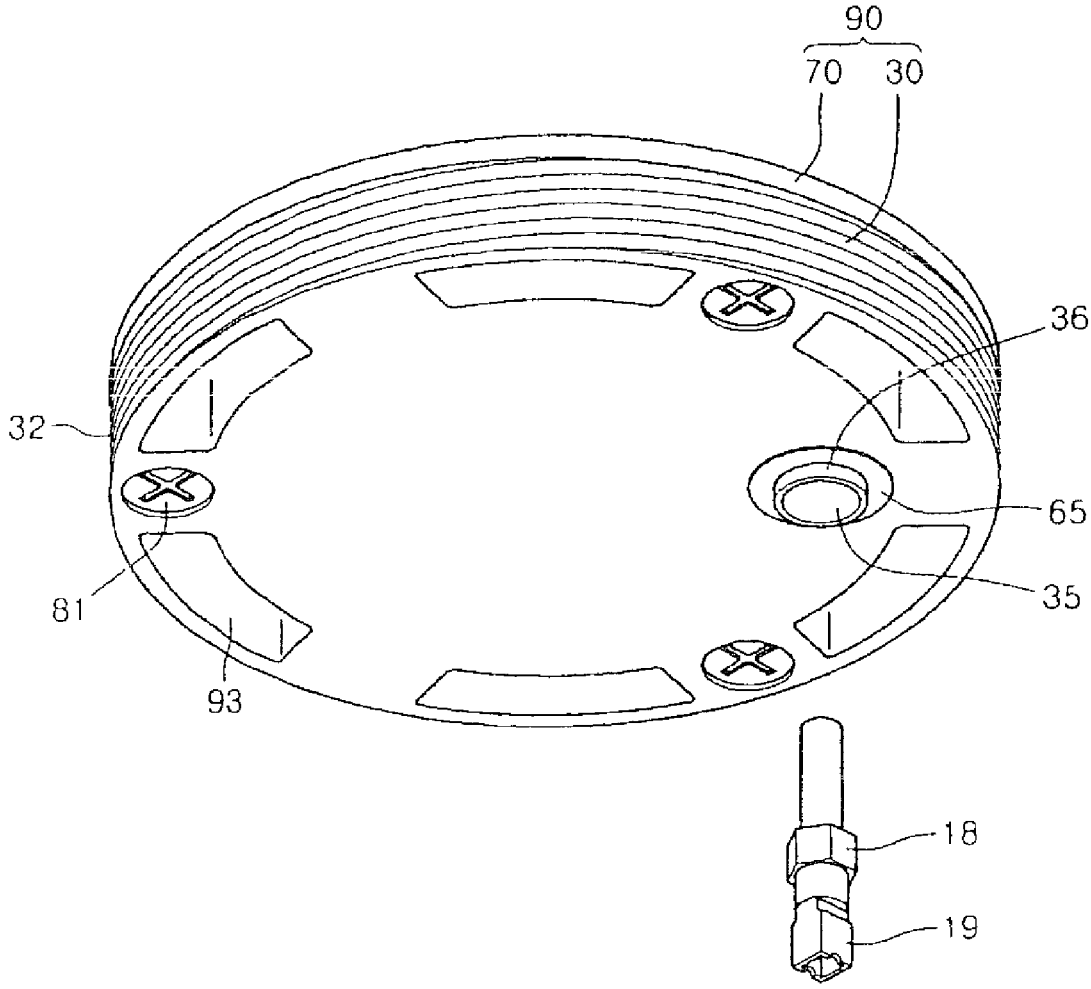
FIG. 11 is a perspective view of a lighting device according to a fourth embodiment when viewed from below.

FIG. 11 is a perspective view of a lighting device according to a fourth embodiment when viewed from below.

Referring to FIG. 11, a case body 30 has a receiving space such as a receiving cavity. A case cover 70 has a ring shape corresponding to that of the case body 30.

The case body 30 and the case cover 70 are coupled to each other to form a case 90. The case 90 constitutes a body of the lighting device to receive a heatsink plate, a light emitting module, a gap member, a lens, and a first protection ring.

According to the fourth embodiment, a helix 32 instead of the second hole formed for attaching the lighting device to the wall surface in the first embodiment is disposed on a circumference surface of the case 90. A screw groove (not shown) corresponding to the helix 32 may be disposed in a position at which the lighting device is attached to an external support member such as a wall surface, a streetlight, or an automobile. Thus, the helix 32 is fitted into the screw groove (not shown) to attach the lighting device to the external support member such as the wall surface, the streetlight, or the automobile.

Therefore, the lighting device may be easily attached to the external support member such as the wall surface, the streetlight, or the automobile without using a screw.

A method of attaching the lighting device to the external support member such as the wall surface, the streetlight, or the automobile is not limited to the first and third embodiments and may be various changed as necessary.

According to the embodiments, the lighting device having the superior thermal dissipation property and waterproof property may be provided.

According to the embodiments, the lighting device capable of easily obtaining the desired light distribution may be provided.

According to the embodiments, the lighting device having the improved insulation resistivity may be provided.

According to the embodiments, the lighting device that can easily perform maintenance and repair thereof may be provided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light emitting module including a substrate and a light emitting device mounted on the substrate;

a case body receiving the light emitting module;

a gap member wider than the substrate;

a lens on the light emitting module;

a first ring provided on a peripheral portion of the lens; and a case cover coupled with the case body and having an opening, wherein the case body is provided therein with a coupling cavity in which the gap member is seated, and a lateral portion of the gap member is supported by the case body, and wherein the lens includes a first portion between the ring and the gap member and a second portion that extends outward from the first portion through the opening of the case cover.

2. The lighting device of claim 1, further comprising a heatsink plate under the substrate of the light emitting module.

3. The lighting device of claim 1, wherein the gap member is interposed between the light emitting module and the lens so that the light emitting module is spaced apart from the lens.

4. The lighting device of claim 1, further comprising:

a through hole formed through a bottom surface of the case body; and a lead electrode electrically connected to the substrate and exposed to an outside by the through hole.

5. The lighting device of claim 4, further comprising a second ring protruding from the bottom surface of the case body and is formed on a peripheral portion of the through hole.

6. The lighting device of claim 1, wherein the case body is provided at a boundary surface thereof with an inner wall and an outer wall, and at least one first hole is formed between the inner wall and the outer wall, wherein a protrusion is formed from a peripheral portion of the case cover and is inserted into the first hole, and the protrusion includes a screw groove, and wherein a coupling screw is inserted into the screw groove through the first hole and is coupled with the screw groove.

7. The lighting device of claim 1, wherein the case body is provided at a peripheral portion thereof with at least one hole screwed with an external support member.

8. The lighting device of claim 1, wherein the case body is provided at a peripheral portion thereof with a helix coupled with an external support member.

9. The light emitting device of claim 1, wherein the case body and the case cover are provided at a peripheral portion thereof with at least one heatsink hole to radiate heat emitted from the light emitting module.

10. The lighting device of claim 1, wherein the first ring surrounds a top surface and a lateral surface of an edge of the lens and is interposed between the edge of the lens and an internal lateral surface of the case cover.

11. The lighting device of claim 5, wherein the first ring or the second ring includes water-proof rubber or silicone material.

12. The lighting device of claim 1, wherein the case cover has an inclined lateral surface.

13. The lighting device of claim 1, wherein a boundary surface of the case body and the case cover has one of a circular shape, a square shape, a polygonal shape, and an oval shape.

14. The lighting device of claim 1, wherein the case cover is disposed around the lens.

15. The lighting device of claim 1, wherein the gap member is thinner than the case cover.

16. A lighting device comprising:

a light emitting module including a substrate and a light emitting device mounted on the substrate;

a case body receiving the light emitting module;

a gap member wider than the substrate;

a lens on the light emitting module;

a first ring provided on a peripheral portion of the lens; and a case cover coupled with the case body and having an opening, wherein the case body is provided therein with a coupling cavity in which the gap member is seated, and a lateral portion of the gap member is supported by the case body, wherein the case body is provided at a boundary surface thereof with an inner wall and an outer wall, and at least one first hole is formed between the inner wall and the outer wall, wherein a protrusion is formed from a peripheral portion of the case cover and is inserted into the first hole, and the protrusion includes a screw groove, and wherein a coupling screw is inserted into the screw groove through the first hole and is coupled with the screw groove.

17. The lighting device of claim 16, further comprising a heatsink plate under the substrate of the light emitting module.

18. The lighting device of claim 16, wherein the gap member is interposed between the light emitting module and the lens so that the light emitting module is spaced apart from the lens.

19. The lighting device of claim 16, further comprising:

a through hole formed through a bottom surface of the case body; and a lead electrode electrically connected to the substrate and is exposed to an outside by the through hole.

20. The lighting device of claim 19, further comprising a second ring protruding from the bottom surface of the case body and is formed on a peripheral portion of the through hole.

* * * * *